US007872552B2

(12) United States Patent
Adunka et al.

(10) Patent No.: US 7,872,552 B2
(45) Date of Patent: Jan. 18, 2011

(54) METHOD AND DEVICE FOR THE SECURE OPERATION OF A SWITCHING DEVICE

(75) Inventors: Robert Adunka, Sulzbach-Rosenberg (DE); Peter Hartinger, Bodenwöhr (DE); Bardo Koppmann, Kaltenbrunn (DE); Norbert Mitlmeier, Ursensollen (DE); Ludwig Niebler, Laaber (DE); Fritz Pohl, Hemhofen (DE); Alf Wabner, Amberg (DE); Norbert Zimmermann, Sulzbach-Rosenberg (DE)

(73) Assignee: Siemens Aktiengesellschaft, Munich (DE)

( * ) Notice: Subject to any disclaimer, the term of this patent is extended or adjusted under 35 U.S.C. 154(b) by 530 days.

(21) Appl. No.: 11/793,714

(22) PCT Filed: Dec. 22, 2005

(86) PCT No.: PCT/EP2005/057082

§ 371 (c)(1),
(2), (4) Date: Jun. 21, 2007

(87) PCT Pub. No.: WO2006/069963

PCT Pub. Date: Jul. 6, 2006

(65) Prior Publication Data

US 2008/0036562 A1 Feb. 14, 2008

(30) Foreign Application Priority Data

Dec. 23, 2004 (DE) ..... 10 2004 062 267

(51) Int. Cl.

| | |
|---|---|
| ***H01H 75/00*** | (2006.01) |
| ***H01H 77/00*** | (2006.01) |
| ***H01H 83/00*** | (2006.01) |
| ***H01H 67/02*** | (2006.01) |

(52) U.S. Cl. ..... 335/132; 335/6

(58) Field of Classification Search ..... 335/132
See application file for complete search history.

(56) References Cited

U.S. PATENT DOCUMENTS 4,292,611 A * 9/1981 Bresson et al. ..... 335/6

(Continued)

FOREIGN PATENT DOCUMENTS

CN 101084561 A 12/2007

(Continued)

OTHER PUBLICATIONS

Translation of Korean Office Action.

(Continued)

*Primary Examiner*—Anh T Mai
*Assistant Examiner*—Alexander Talpalatskiy
(74) *Attorney, Agent, or Firm*—Harness, Dickey & Pierce, P.L.C.

(57) ABSTRACT

A method and a device for the secure operation of a switching device are disclosed, including at least one main contact which can be switched on and off and which includes contact pieces and a displaceable contact bridge, and also at least one control magnet which includes a displaceable anchor. The anchor acts upon the contact bridge when it is switched on or off such that the corresponding main contact is opened and closed. In at least one embodiment, the method includes: a) the displaceable contact bridge of the at least one main contact recognizes when an opening point has been exceeded after being switched off, and b) the additional operation of the switching device is interrupted, according to a predetermined duration of time, when the opening point is not exceeded.

23 Claims, 4 Drawing Sheets

U.S. PATENT DOCUMENTS

| | | | | | |
|---|---|---|---|---|---|
| 4,307,358 | A | * | 12/1981 | Haury et al. | 335/6 |
| 4,470,028 | A | * | 9/1984 | Vayre et al. | 335/16 |
| 4,737,749 | A | | 4/1988 | Held | |
| 4,803,587 | A | * | 2/1989 | Fournier et al. | 361/24 |
| 5,099,385 | A | * | 3/1992 | Faffart | 361/245 |
| 5,163,175 | A | * | 11/1992 | Mori et al. | 335/132 |
| 5,455,733 | A | | 10/1995 | Waggamon | |
| 5,986,528 | A | * | 11/1999 | Meier et al. | 335/6 |
| 6,023,110 | A | | 2/2000 | Henrion et al. | |
| 6,150,909 | A | * | 11/2000 | Meier | 335/132 |
| 6,833,777 | B2 | * | 12/2004 | Bollinger et al. | 335/6 |
| 6,943,654 | B2 | * | 9/2005 | Zhou et al. | 335/106 |

FOREIGN PATENT DOCUMENTS

| | | | |
|---|---|---|---|
| DE | 3540460 | | 5/1987 |
| DE | 19734224 | C1 | 2/1999 |
| DE | 19937074 | C1 | 6/2001 |
| DE | 69612975 | T2 | 11/2001 |
| EP | 0 224 081 | B1 | 2/1991 |
| EP | 0224081 | B1 | 2/1991 |
| EP | 0 694 937 | B1 | 3/2000 |
| EP | 0 832 496 | B1 | 5/2001 |
| EP | 0832496 | B1 | 5/2001 |
| EP | 1 298 689 | A2 | 4/2003 |
| EP | 1298689 | A2 | 4/2003 |
| JP | 7077112 | B | 3/1995 |
| JP | 2008-525950 | | 7/2008 |

OTHER PUBLICATIONS

Chinese Office Action.

Office Action for German patent application No. 10 2004 062 267. 1-34 dated Nov. 2, 2010.

* cited by examiner

METHOD AND DEVICE FOR THE SECURE OPERATION OF A SWITCHING DEVICE

PRIORITY STATEMENT

This application is the national phase under 35 U.S.C. §371 of PCT International Application No. PCT/EP2005/057082 which has an International filing date of Dec. 22, 2005, which designated the United States of America and which claims priority on German Patent Application number 10 2004 062 267.1 filed Dec. 23, 2004, the entire contents of which are hereby incorporated herein by reference.

FIELD

At least one embodiment of the present invention generally relates to a method for the safe operation of a switching device and/or to a corresponding apparatus.

BACKGROUND

With switching devices, in particular low-voltage switching devices, the current paths between an electrical supply device and loads and therefore their operating currents can be switched. Thus, by current paths being opened and closed by the switching device, the connected loads can be switched on and off safely.

An electrical low-voltage switching device, such as a contactor, a circuit breaker or a compact starter, for example, has one or more so-called main contacts, which can be controlled by one or else more control magnets, for the purpose of switching the current paths. In principle, in this case the main contacts include a movable contact link and fixed contact pieces, to which the load and the supply device are connected. In order to close and open the main contacts, a corresponding switch-on or switch-off signal is provided to the control magnets, whereupon the control magnets act with their armature on the movable contact links in such a way that the contact links complete a relative movement in relation to the fixed contact pieces and either close or open the current paths to be switched.

In order to provide better contact between the contact pieces and the contact links, correspondingly designed contact faces are provided at points at which the two meet one another. These contact faces include materials such as silver alloys, for example, which are applied at these points both on the contact link and the contact pieces and have a certain thickness.

The materials of the contact faces are subject to wear in each of the switching operations. Factors which can influence this wear are: the contact erosion or contact abrasion which increases with the increasing number of switching-on and switching-off operations, increasing deformations, increasing contact corrosion owing to the effect of arcs or environmental influences, such as vapors or suspended matter, for example, etc. As a result, the operating currents are no longer switched safely, which may lead to current interruptions, heating of the contacts or contact welding.

Thus, the thickness of the materials applied to the contact faces will be reduced in particular with the increase in contact erosion. The switching path between the contact faces of the contact link and the contact pieces therefore becomes longer, which ultimately reduces the contact force during closing. As a result, with an increasing number of switching operations the contacts no longer close correctly. Owing to the resultant current interruptions or else owing to increased switch-on bouncing of the contacts, the contacts may then be heated and therefore the contact material may be fused to an increasing extent, which in turn may lead to welding of the contact faces of the main contacts.

If a main contact of the switching device has been worn or even has welded, the switching device can no longer safely switch off the load. Thus, precisely in the case of a welded contact, at least the current path with the welded main contact will continue to carry a current or voltage, despite the switch-off signal, and the load is therefore not completely isolated from the supply device. Since, therefore, the load remains in an unsafe state, the switching device represents a potential source of faults.

As a result, for example in the case of compact starters according to IEC 60 947-6-2, in which an additional protective mechanism acts on the same main contacts as the control magnet during operational switching, the protective function may be blocked.

For the safe operation of switching devices and therefore in order to protect the load and the electrical system, such sources of faults therefore need to be avoided.

SUMMARY

At least one embodiment of the present invention identifies potential sources of faults and responds to them in a corresponding manner.

At least one embodiment of the present invention therefore makes it possible, with little complexity, to identify contact welding during switching-off and thus to identify an operation of the switching device which is no longer safe and to respond to this in a corresponding manner.

According to at least one embodiment of the invention, for this purpose it is identified during operation of a switching device during switching-off whether the movable contact link of the at least one main contact has exceeded an opening point, and continued operation of the switching device is interrupted if, after a predetermined period of time, the opening point has not been exceeded.

The predetermined opening point in this case corresponds to a previously determined opening path of the contact link. At this point, the contact link is just still connected to the contact pieces. If then, after the switching-off, i.e. after the desired opening of the at least one main contact, an opening path is determined which is less than or at least less than or equal to this predetermined opening point, it can be assumed that there is welding and therefore operation of the switching device which is not safe.

Movable contact links in switching devices are in this case often in the form of a bow, in each case one contact face being applied to the two opposite ends of the bow. When the switching device is switched on, a contact link is then moved in such a way that its contact faces meet the corresponding contact faces of the two associated stationary contact pieces and therefore connect the load to the electrical supply device. During switching-off, however, the contact link is moved in such a way that the corresponding contact faces are isolated, thus the main contact is opened and therefore the load is isolated from the electrical supply device. In order, in particular during switching-on, to safely ensure that the two contact faces meet the corresponding contact faces of the stationary contact pieces, contact links are designed such that they are not rigid, but have a certain permissible flexibility. If welding or a type of bonding of at least one of the contact faces of the contact link with the contact faces of the corresponding stationary contact pieces now takes place, during switching-off the contact link will first bend owing to its flexibility and then remain in a position which does not represent a safe operating case of the switching device in the open state.

If the occurrence of such an unsafe operating case during continuous operation is monitored and identified, continued operation of the switching device can be suppressed in good time.

Thus, safe operation of a switching device, such as a contactor, a circuit breaker or a compact branch, for example, and in particular safe operation of a three-pole switching device is ensured with the method according to at least one embodiment of the invention and the apparatus according to at least one embodiment of the invention.

Further advantageous embodiments and preferred developments of the invention are given in the disclosure below.

BRIEF DESCRIPTION OF THE DRAWINGS

The invention and advantageous embodiments thereof will be described in more detail below with reference to the following figures, in which.

DETAILED DESCRIPTION OF THE EXAMPLE EMBODIMENTS

Figure 1:
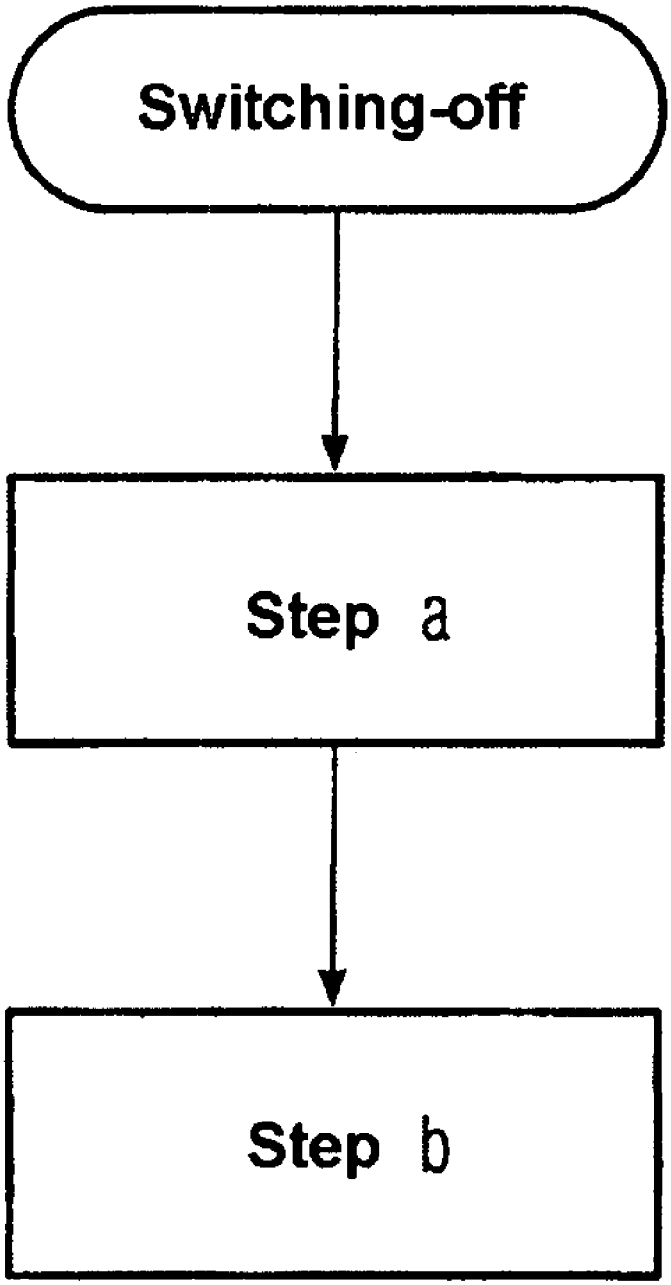
FIG. 1 shows a simplified flowchart of the method according to an embodiment of the invention.

As shown in FIG. 1, in the method according to an embodiment of the invention, essentially the two following steps are carried out after a switch-off signal:

Step a) identifying whether the movable contact link of the at least one main contact has exceeded an opening point after the switching-off, and Step b) interrupting continued operation of the switching device if, after a predetermined period of time, the opening point has not been exceeded.

Thus, after the operational switching-off, i.e. in particular after a switch-off signal for opening the three main contacts of a three-pole switching device, a check is performed to ascertain whether all of the main contacts of the switching device have been opened.

In this case, a main contact includes two contact pieces which are connected to one another via a movable contact link. That is to say the main contact can be switched on or off, and thus a load can be connected to a supply device or isolated from it. In general, the movable contact links in switching devices are designed such that they have the shape of a bow, in each case one contact face being applied to the two opposing ends of the bow. When the switching device is switched on, these contact links are then moved in such a way that their contact faces meet the corresponding contact faces of the contact pieces and therefore connect the load to the electrical supply device. During switching-off, however, the contact pieces are moved in such a way that the corresponding contact pieces are isolated and therefore the load is isolated from the electrical supply device.

In order, in particular during switching-on, to safely ensure that the two contact faces meet the corresponding contact faces of the stationary contact pieces, these contact links are not designed to be rigid, but have a certain permissible flexibility. This flexibility is achieved, for example, by the selection of a suitable material or by the shaping of the contact bow.

Thus, each movable and flexible contact link has a pair of contact faces and therefore two switching points. If these contact faces become welded to the corresponding contact faces of the associated contact bows, the switching points no longer open owing to the welding, and erroneous functioning of the switching device occurs. In this case, a possible fault case of the switching device may be provided when only one contact face on one side of the contact bow has welded. In this case, during opening, the contact link will move away from the contact pieces only on one side. Owing to the bonding on the other side, the contact link will only be able to move within the realms of the predetermined flexibility, and then will remain in a position which does not correspond to a safe state of the switching device in the open state. In another, further possible fault case, the two contact faces of the contact link are welded to the corresponding contact faces of the contact pieces. In this case, owing to the welding on both sides, the contact link in turn will only bend within the realms of its predetermined flexibility, but then will also remain in a position which does not represent a safe operating state of the switching device in the open state.

According to an embodiment of the invention, a check is therefore carried out to ascertain whether the movable contact links have covered a certain opening path during opening, which opening path is greater than an opening point which was specified in advance and therefore was predetermined. If the identified opening path of one of the contact links is still below this opening point after opening, even after a likewise predetermined period of time has elapsed, it can be assumed that there is contact welding, with the result that continued operation of the switching device needs to be interrupted.

If there is such a fault case, the interruption of continued operation can take place, for example, by a redundant, further device-internal switching element opening, which switching element is connected in series with the main contacts. Irrespective of whether the main contacts are open or closed, the switching element then isolates the load from the supply device. As a result of the fact that the switching element can no longer close easily, continued operation of the switching device is safely suppressed. As an alternative for opening this additional switching element, in the event of a fault, driving of the control magnet until it is reset can also be interrupted and therefore blocked. In addition, a correspondingly pronounced energy store mechanism can be triggered device-internally which acts on the welded main contact(s) in such a way that it or they are broken apart again and therefore opened.

Figure 2:
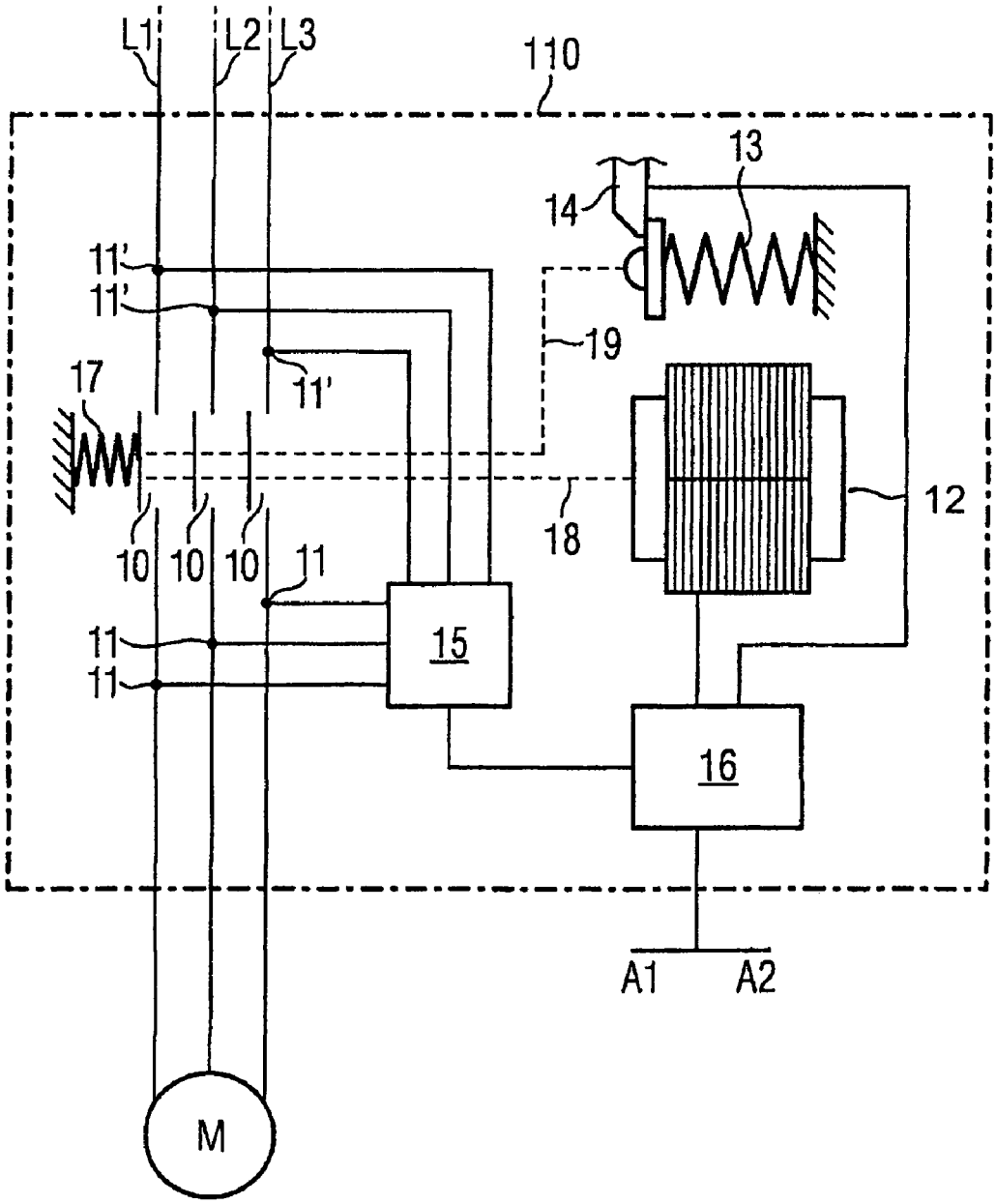
FIG. 2 shows a first embodiment of the apparatus according to the invention.

FIG. 2 shows, schematically, a first example embodiment of a switching device 110 having the apparatus according to the invention. The switch-on and switch-off control signals for switching the main contacts 10 on and off are applied to the control magnets 12 via terminals A1 and A2 and a control device 16. During switching-off, the control magnet, which acts as an electromagnetic drive 12 for the main contacts, is de-energized via the control device 16. In this case, a force counter to the contact load spring 17 acts on the contact links via the connection 18. The main contacts 10 are opened in this way and therefore the load M is isolated from the supply device, in this case identified by the three lines L1-L3.

Once the control magnet 12 has been de-energized, in addition a check is carried out by an evaluation device 15 by way of the electrodes 11 and 11' to ascertain whether the contact links have exceeded the predetermined opening point. In order to measure a voltage drop across the main contacts 10, in the present exemplary embodiment in each case two electrodes 11 and 11' are provided for each current path, to be precise one upstream of the main contact 10 and one downstream of the main contact. According to an embodiment of the invention, once the main contacts 10 have been switched off, a voltage check via the main contacts 10 is then carried out by the evaluation device 15 via the electrodes 11 and 11'. If the voltage drop at one of the main contacts 10 is too low, this is an indication of the fact that the main contact has not opened far enough. That is to say the opening path covered by the contact link during switching-off has not exceeded the predetermined value, and it is highly probable that there is welding.

If, after a predetermined period of time, of 100 ms, for example, since a switch-off signal was triggered, an opening path which is still too small is identified, it is necessary to ensure that continued operation of the switching device is interrupted. In the present example embodiment, the evaluation device 15 is therefore connected to the control device 16 via a connection, which is not provided with a designation. If such a fault case is now identified by the evaluation device 15, this fault case is communicated to the control device 16, whereupon the control device 16 interrupts at least one of the control lines.

In addition, in the present example embodiment a triggering mechanism 14 is activated with which a spring energy store 13 is unlatched. Such spring energy stores may be, for example, switching mechanisms which are already known for circuit breakers or compact starters. Such a switching mechanism then impacts, mechanically with a high force, on the unopened main contacts 10 of the switching points of the switching device via a connection 19, in order to break the welded main contacts apart. In order to break the main contacts apart, the force of the spring store 13 needs to be dimensioned such that it is correspondingly high. The spring store 13 then either remains in the unlatched position and can no longer be reset, or the spring store 13 has a mechanism by way of which the spring can be tensioned again and the tripping mechanism 14 can be latched again. Since the mechanisms 13 and 14 can only be reset manually, an operator is made aware of the fault case and needs to respond to it correspondingly, for example by replacing the switching device.

The embodiment of the present invention illustrated in FIG. 2, in which the method according to an embodiment of the invention is therefore also used, is particularly suitable if each of the main contacts 10 is intended to be monitored separately, in particular, however, also in the case of single-phase switching devices with only one main contact. If both contact faces of a contact link have become bonded, this state of the main contact 10 which is no longer safe can therefore be identified, for example, using an auxiliary voltage applied to the main contact 10 via the electrode pair 11 and 11'. In this case, after the opening, the auxiliary voltage will continue to be present across the bonded main contact. By the evaluation device 15 monitoring this auxiliary voltage or else the current which results owing to the equivalent resistance of the main contact, it is possible to identify that the contact link of this main contact 10 has not exceeded the opening point owing to the welding. The evaluation device will then pass this identified fault case on to the control device 16 and therefore interrupt continued operation of the switching device owing to the fault case which has occurred.

As an alternative to the above-described method with the auxiliary voltage, further embodiments are also conceivable. Thus, for example, the difference in the voltages between the load side at the electrode 11 and the system side at the electrode 11' can be evaluated via the evaluation device. Or quite simply the presence of the system voltage at the load-side electrode 11 is checked.

In a further example embodiment which is not illustrated in any more detail, only one current sensor per current path may also be provided. This can be used in particular in two-phase or polyphase switching devices. Then, it is identified via the current measurement in each of the current paths whether the opening point has been exceeded after the switching-off. If, owing to the current measurement, it has been identified that the opening point has not been exceeded, continued operation of the switching device is interrupted.

Figure 3:
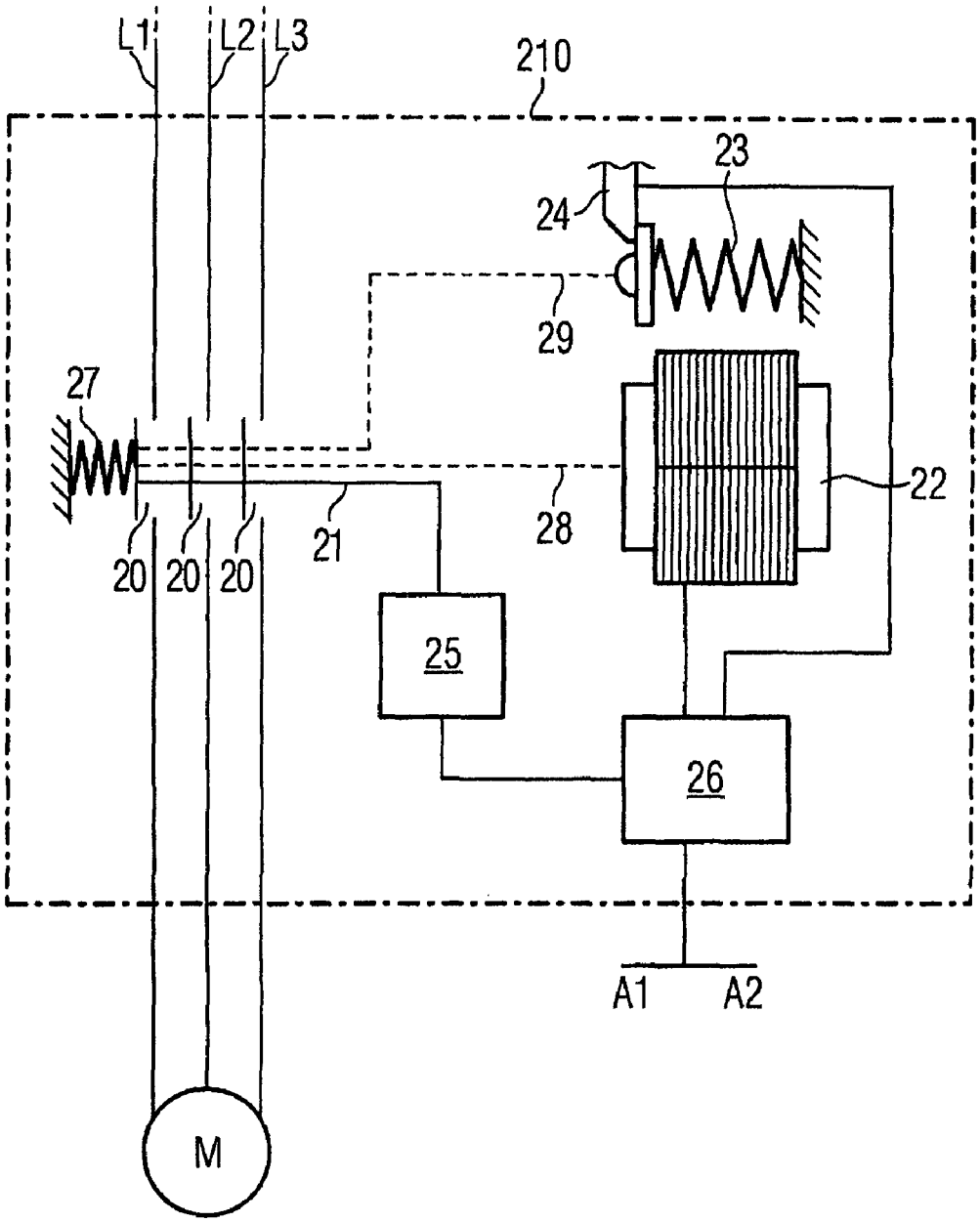
FIG. 3 shows a second embodiment of the apparatus according to the invention.

FIG. 3 shows, schematically, a further example embodiment of a switching device 210 having the apparatus according to the invention, in which the opening path to be identified of the contact links of the switching point 20 is interrogated directly by the evaluation device 25. This can take place, for example, by way of corresponding device 21, which are not illustrated in any more detail in FIG. 3, however. It is thus possible, for example, for switching monitoring device(s) to be provided which are changed over to a first state if the main contacts are closed during switching-on and remain in this first state even after the switching-off if at least one of the main contacts has welded. The switching device 210 also includes control magnets 22 and a control device 26, a contact load spring 27 and a connection 28. In addition, in the present exemplary example embodiment a triggering mechanism 24 is activated with which a spring energy store 23 is unlatched. Such a switching mechanism then impacts, mechanically with a high force, on the unopened main contacts 20 of the switching points of the switching device via a connection 29, in order to break the welded main contacts apart. In order to break the main contacts apart, the force of the spring store 23 needs to be dimensioned such that it is correspondingly high.

In this case, it is assumed that the identified opening path has fallen below the predetermined value if these device(s) remain in this first state after the switching-off, which state does not correspond to the predetermined state after opening.

The embodiment of the present invention illustrated in FIG. 3, in which the method according to an embodiment of the invention is therefore also used, is particularly suitable if the welding or bonding of a contact face is intended to be identified on only one side of the contact link. Precisely in such a fault case, the main contact 20 will open when the load is switched off, but the contact link will only cover a path which does not ensure a safe state of the switching device. Instead, it is to be expected that, in such a fault case, the second contact face will also soon become welded on the opposite side of the contact link owing to the increasing erosion. If, during switching-off, the evaluation device 25 identifies via the device(s) 21 that the contact link of the main contact 20 has only covered a path which is below the opening point for the safe open state, owing to the welding on one side, continued operation of the switching device can be interrupted.

Advantageously, this embodiment illustrated in FIG. 3 could also be combined with the measures described in connection with FIG. 2. Thus, one-sided welding can be identified, for example, by the device(s) 21, which triggers a first indication that failure of the switching device is imminent owing to a main contact no longer opening. The actual interruption of continued operation of the switching device could, however, only take place when, during continued operation, it is identified, via an auxiliary voltage at additional electrodes, such as the electrodes 11 and 11', for example, that the main contact now does not open any more at all owing to the bonding on both sides.

As a further example embodiment of the identification of the opening path of the main contacts, an inductance measurement directly at the coil of the control magnet would also be conceivable. The control magnet has a different inductance in the regular switched-on state than in the switched-off state. If this inductance of the switched-off state is not reached after the switching-off, it is assumed that the opening point has not been exceeded and the switching device will be disconnected.

Figure 4:
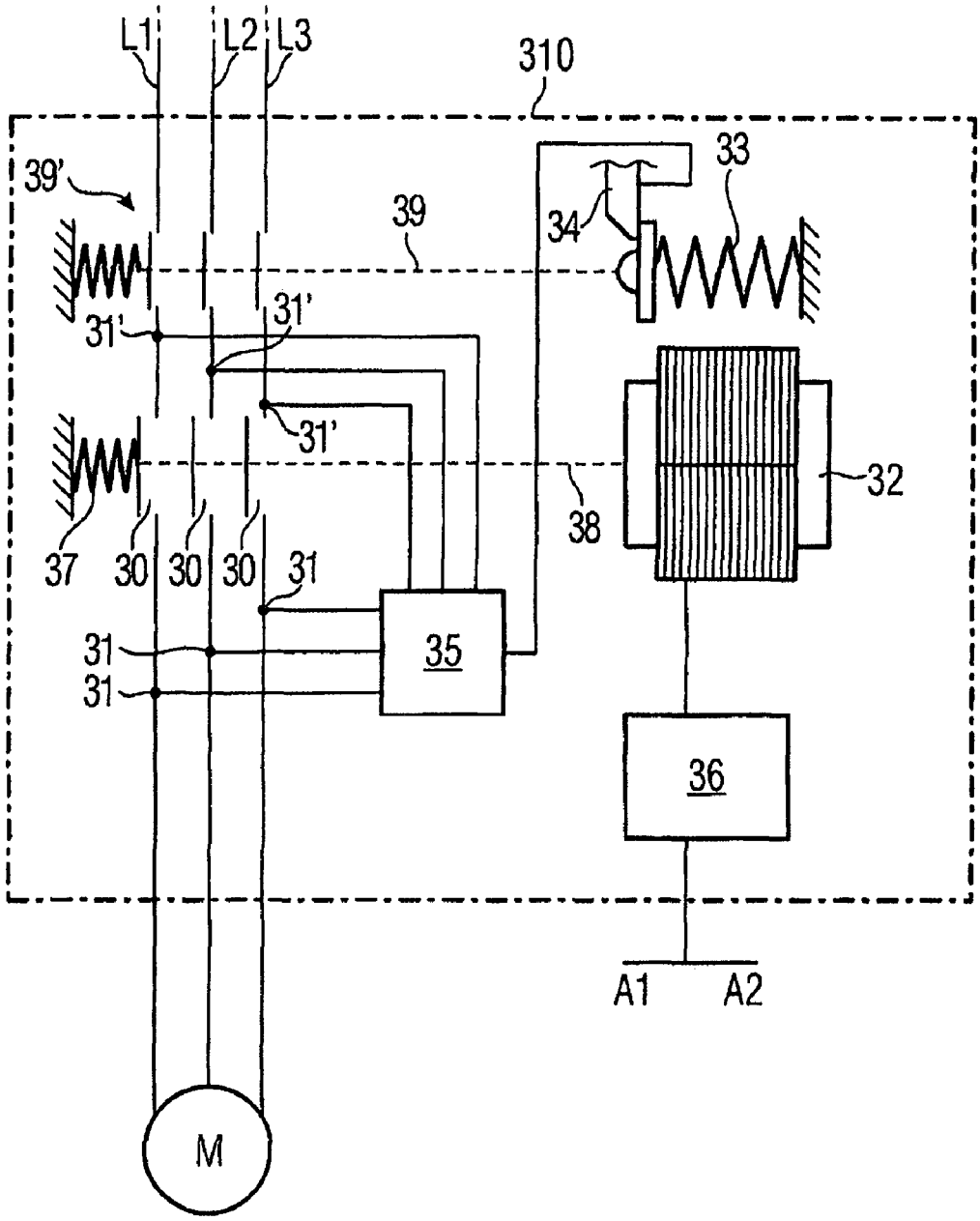
FIG. 4 shows a third embodiment of the apparatus according to the invention.

FIG. 4 shows a further example embodiment of a switching device 310 having the apparatus according to the invention. Here, in the event of a fault, in order to interrupt continued operation a further switching element 39' is provided which is arranged in the individual current paths in series with the actually switching main contacts 30. In the case of welding of one of the main contacts 30, the evaluation device 35 identifies a voltage drop across this main contact which is too low by way of the electrodes 31 and 31'. As a result, the evaluation device 35 causes a tripping mechanism 34 to be activated and therefore a spring energy store 33 to be unlatched. This spring energy store 33 acts on the switching element 39' via the operative connection 39 and opens it. As a result, the current paths are interrupted safely and independently of whether the main contacts are open or still closed, and continued operation of the switching device is suppressed. The switching device 310 also includes control magnets 32 and a control device 36, a contact load spring 37 and a connection 38.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

The invention claimed is:

1. A method for the safe operation of a switching device including at least one main contact, the at least one main contact being switchable on and off and including a movable contact link, a further switching element arranged in series with and upstream of the at least one main contact, and the switching device further including at least one control magnet with a movable armature, the armature acting on the contact link during switching-on and switching-off such that the corresponding main contact is closed and opened, the method comprising:

identifying whether the movable contact link of the at least one main contact has exceeded an opening point after the switching-off; and interrupting continued operation of the further switching element if, after a period of time, the opening point has not been exceeded, by activating a force stored in an energy store mechanism to mechanically impact on the further switching element with a result of opening said further switching element and interrupting continued operation of said further switching element.

2. The method as claimed in claim 1, wherein the opening point being exceeded is identified by measurement of a current in a current path to be switched by the main contact, and wherein the opening point as not having been exceeded is identified if the measured current is greater than a current provided after the switching-off.

3. The method as claimed in claim 1, wherein the opening point being exceeded is identified by measurement of a voltage drop across a main contact, and wherein the opening point not having been exceeded is identified if the voltage drop is smaller than a voltage drop provided after the switching-off.

4. The method as claimed in claim 1, wherein the opening point being exceeded is identified by measurement of an inductance of the control magnet, and wherein the opening point not having been exceeded is identified if the inductance after the switching-off has a value which does not correspond to the predetermined value after the opening.

5. The method as claimed in claim 1, wherein the opening point is identified from a state of at least one device operatively connected to the contact link, the opening point not having been exceeded being identified if the at least one device remains in this state after the switching-off, which state does not correspond to a state after the opening.

6. The method as claimed in claim 1, wherein the continued operation is interrupted by a switching element arranged in series with the main contact in the current path being opened.

7. The method as claimed in claim 1, wherein the continued operation is interrupted by at least one control line for controlling the control magnet being interrupted.

8. An apparatus for the safe operation of a switching device, the switching device including at least one main contact, the at least one main contact being switchable on and off and including a movable contact link, the switching device further including at least one control magnet with a movable armature, the armature acting on the contact link during switching-on and switching-off such that the corresponding main contact is closeable and openable, the apparatus comprising:

first means for identifying whether an opening point of the contact link of the at least one main contact has been exceeded;

a further switching element arranged in series with and upstream of the at least one main contact and further means for interrupting the continued operation of the switching device if the first means identify, after the switching-off, that the opening point has not been exceeded after a period of time, wherein said further means includes an energy store mechanism configured to interrupt the continued operation of the further switching element by releasing a force stored therein to mechanically impact on the further switching element with a result of breaking open said contacts of further switching element.

9. The apparatus as claimed in claim 8, wherein the first means includes a first current sensor located upstream of the at least one main contact and a second current sensor located downstream of the at least one main contact to measure the current in a current path to be switched by the main contact and the further means for interrupting the continued operation of the switching device is between the first means and the at least one main contact.

10. The apparatus as claimed in claim 8, wherein the first means includes two electrodes, a first and a second electrode being arranged such that a voltage drop across the main contact is dischargeable.

11. The apparatus as claimed in claim 8, wherein the first means includes means for detecting an inductance of the control magnet.

12. The apparatus as claimed in claim 8, wherein the first means includes an opening mechanism, operatively connected to the contact link and able to assume a first and second state.

13. The apparatus as claimed in claim 8, wherein the further means includes an evaluation device to open a switching element, arranged in series with the main contact in the current path, to interrupt continued operation.

14. The apparatus as claimed in claim 8, wherein the further means includes a control device for controlling the control magnet, the control device interrupting the control line to the control magnet in order to interrupt continued operation.

15. A switching device to carry out the method as claimed in claim 1 for safely switching loads, the switching device being at least one of a contactor, a circuit breaker and a compact branch.

16. A switching device for safely switching loads, comprising:

an apparatus as claimed in claim 8, the switching device being at least one of a contactor, a circuit breaker and a compact branch.

17. The switching device as claimed in claim 15, wherein the switching device is a three-pole switching device including three main contacts for switching three current paths on and off with a control magnet.

18. The apparatus as claimed in claim 9, wherein the further means includes an evaluation device to open a switching element, arranged in series with the main contact in the current path, to interrupt continued operation.

19. The apparatus as claimed in claim 9, wherein the further means includes a control device for controlling the control magnet, the control device interrupting the control line to the control magnet in order to interrupt continued operation.

20. The apparatus as claimed in claim 10, wherein the further means includes an evaluation device to open a switching element, arranged in series with the main contact in the current path, to interrupt continued operation.

21. The apparatus as claimed in claim 10, wherein the further means includes a control device for controlling the control magnet, the control device interrupting the control line to the control magnet in order to interrupt continued operation.

22. The switching device as claimed in claim 16, wherein the switching device is a three-pole switching device including three main contacts for switching three current paths on and off with a control magnet.

23. A switching device for safely switching loads, comprising:

at least one main contact, the at least one main contact being switchable on and off and including a movable contact link;

at least one control magnet with a movable armature, the armature acting on the contact link during switching-on and switching-off such that the corresponding main contact is closeable and openable;

a sensor configured to identify whether an opening point of the contact link of the at least one main contact has been exceeded;

a further switching element arranged in series with and upstream of the at least one main contact;

an evaluation device configured to interrupt continued operation of the switching device when the sensor identifies, after the switching-off, that the opening point has not been exceeded after a period of time; and an energy store mechanism configured to interrupt the continued operation of the switching device by releasing a force stored therein to mechanically impact on further switching element with a result of interrupting continued operation of the further switching element.

* * * * *